US006041502A

United States Patent [19]

Stanley

[11] Patent Number: 6,041,502

[45] Date of Patent: Mar. 28, 2000

[54] METHOD FOR REMOVING FLUID SEALS FROM A CARRIER

[75] Inventor: Philip M. Stanley, Farmington, N.Y.

[73] Assignee: Xerox Corporation, Stamford, Conn.

[21] Appl. No.: 09/004,260

[22] Filed: Jan. 8, 1998

[51] Int. Cl.[7] ..... H01B 19/00

[52] U.S. Cl. ..... 29/890.1; 29/458; 29/840

[58] Field of Search ..... 29/740, 759, 832, 29/840, 890.1, 426.1, 426.5, 458; 221/74; 414/416

[56] References Cited

U.S. PATENT DOCUMENTS

| | | | |
|---|---|---|---|
| 4,670,976 | 6/1987 | Stridsberg et al. . | |
| 4,850,780 | 7/1989 | SafabakHsh et al. . | |
| 4,915,565 | 4/1990 | Bond et al. . | |
| 5,272,800 | 12/1993 | Rooney et al. . | |
| 5,519,425 | 5/1996 | Dietl et al. | 347/87 |
| 5,784,777 | 7/1998 | Asai et al. . | |

*Primary Examiner*—John Preta
*Attorney, Agent, or Firm*—Robert A. Chittum

[57] ABSTRACT

A method for seriatim feeding and aligning of a plurality of fluid seals spaced apart on a carrier member to a fixed location in a punch mechanism. After each fluid seal is aligned at the fixed location, the carrier member is gripped on opposing sides of the aligned fluid seal by a pair of clamps and, in one embodiment, the clamps lowered with the gripped portion of the carrier member therebetween. A set of parallel needles mounted in a plate located directly beneath the gripped portion of the carrier member penetrate the lowered portion of the carrier member and lift the fluid seal from the carrier member. The removed fluid seal is held atop the needle points for ease of access by a robotic installation mechanism which will pickup and place the fluid seal onto a device, such as an ink jet cartridge. In another embodiment, the support plate with the needles are lifted into penetrating contact with the portion of the carrier member gripped by the clamps to remove the aligned fluid seal and present it to the installation mechanism.

7 Claims, 5 Drawing Sheets

METHOD FOR REMOVING FLUID SEALS FROM A CARRIER

BACKGROUND OF THE INVENTION

This invention relates to method and apparatus for removing fluid seals from a carrier, and more particularly to the automated rapid removal of fluid seals having an adhesive on opposite sides thereof from a continuous strip of carrier material for presentation to a robotic apparatus which picks up the removed fluid seals and installs them on a device, such as, for example, an ink jet cartridge.

In the mass assembly of devices, each having a double sided adhesive coated fluid seal, the process for installing the fluid seal is complex and costly, especially when high reliability and accurate repeatability is required. One way to reduce the cost is to increase productivity; i.e., increase the speed of the process without reducing reliability or repeatability. The present invention provides such cost reducing, increased productivity.

An example of a device using a double-sided, adhesive-coated fluid seal is a thermal ink jet cartridge such as described in U.S. Pat. No. 5,519,425. In this patent, an ink cartridge has an ink supply in a housing and an ink droplet ejecting printhead assembly is fixedly attached thereto. An ink flow path is provided by an elongated recess in the bottom wall of the housing. An outlet port connects one end of the recess to the ink supply in the cartridge housing. A film like fluid seal having an adhesive coating on both sides is installed on the cartridge housing bottom wall over the elongated recess to complete the ink flow path. A slot through the fluid seal is similarly sized to and aligned with the printhead ink inlet when the printhead assembly is permanently mounted on the bottom wall of the cartridge housing. The adhesive coatings on both sides of the fluid seal are cured, so that the adhesive coated on the fluid seal surface confronting the housing bottom wall seals the fluid seal to the cartridge and the adhesive coated on the opposite fluid seal surface bonds the fluid seal to the printhead, thereby providing a leak proof seal or gasket between the printhead and the cartridge. Because the adhesive coating is subjected to the ink, the adhesive must be of a type that is not attacked by the ink. Otherwise, the seal could be damaged and fail, and the ink could be contaminated by the adhesive.

In U.S. Pat. No. 5,519,425, the fluid seals are picked off of a carrier strip by a robotic vacuum pick and place mechanism and positioned on the cartridge bottom wall. However, the removal of the fluid seal from the carrier strip was unreliable and slow, for the adhesive coating on the fluid seal surface contacting the carrier strip presented varying release characteristics when the vacuum pick attempted to separate the fluid seal from the carrier strip.

SUMMARY OF THE INVENTION

It is an object of the present invention to eliminate the problem of varying release characteristics of the fluid seal adhesive coating with a carrier member by a mechanism which rapidly removes the fluid seal from the carrier member in a highly reliable and accurately repeatable manner.

In one aspect of the invention, there is provided a method of removing a fluid seal having an adhesive coating on opposite sides from a carrier member without encountering the effects of varying release characteristics of the adhesive coating which contacts the carrier member, thereby rapidly and reliably presenting the fluid seal for ready installation thereof onto a device, the method comprising the steps of:

providing a plurality of fluid seals on a carrier member, the fluid seals having opposing surfaces, each surface of the fluid seals containing an adhesive coating thereon, the adhesive coating on one fluid seal surface being in contact with the carrier member, and the adhesive coating on the opposing surface of the fluid seal being covered by a release cover member; feeding the carrier member through a punch mechanism; aligning each fluid seal with a fixed location within the punch mechanism; clamping the carrier member at the fixed location in the punch mechanism; mounting a set of parallel needles having sharp points at one end on a support plate; moving the carrier member and set of needles relative to each other and in a direction so that the set of needles approach and penetrate the carrier member, thereby lifting at least one fluid seal from the carrier member; and supporting the at least one fluid seal lifted from the carrier member on the sharp points of the set of needles for presentation to a picking and placing apparatus that will install the at least one fluid seal on a device, the sharp points of the needle set preventing the adhesive coating on the fluid seal which contact said sharp points from becoming attached thereto.

In another aspect of the invention, there is provided an apparatus for removing a fluid seal having an adhesive coating on opposite sides thereof from a carrier member without encountering the effects of varying release characteristics of the adhesive coating which contacts the carrier member, comprising: means for feeding a carrier member to a punch mechanism, the carrier member containing a plurality of fluid seals, each fluid seal having an adhesive coating on opposing sides of the fluid seals, the adhesive coating on one side of the fluid seal being in contact with the carrier member, the adhesive coating on the opposing side of the fluid seal being covered by a release cover member; means for aligning each fluid seal with a fixed location in the punch mechanism; clamps for gripping the carrier member while at least one of the fluid seals is aligned with the fixed location; a set of parallel needles fixedly mounted at one end thereof on a support structure plate with opposite ends of the needles having sharp points; and means for moving the carrier member and set of needles relative to each other and in a direction so that the set of needles approach and penetrate the carrier member, thereby lifting at least one fluid seal from the carrier member; and supporting the at least one fluid seal lifted from the carrier member on the sharp points of the set of needles for presentation to a picking and placing apparatus that will install the at least one fluid seal on a device, the sharp points of the needle set preventing the adhesive coating on the fluid seal which contact said sharp points from becoming attached thereto.

BRIEF DESCRIPTION OF THE DRAWINGS

The present invention will now be described by way of example with reference to the accompanying drawings, wherein like reference numerals refer to like elements, and in which.

DESCRIPTION OF THE PREFERRED EMBODIMENT

Figure 1:
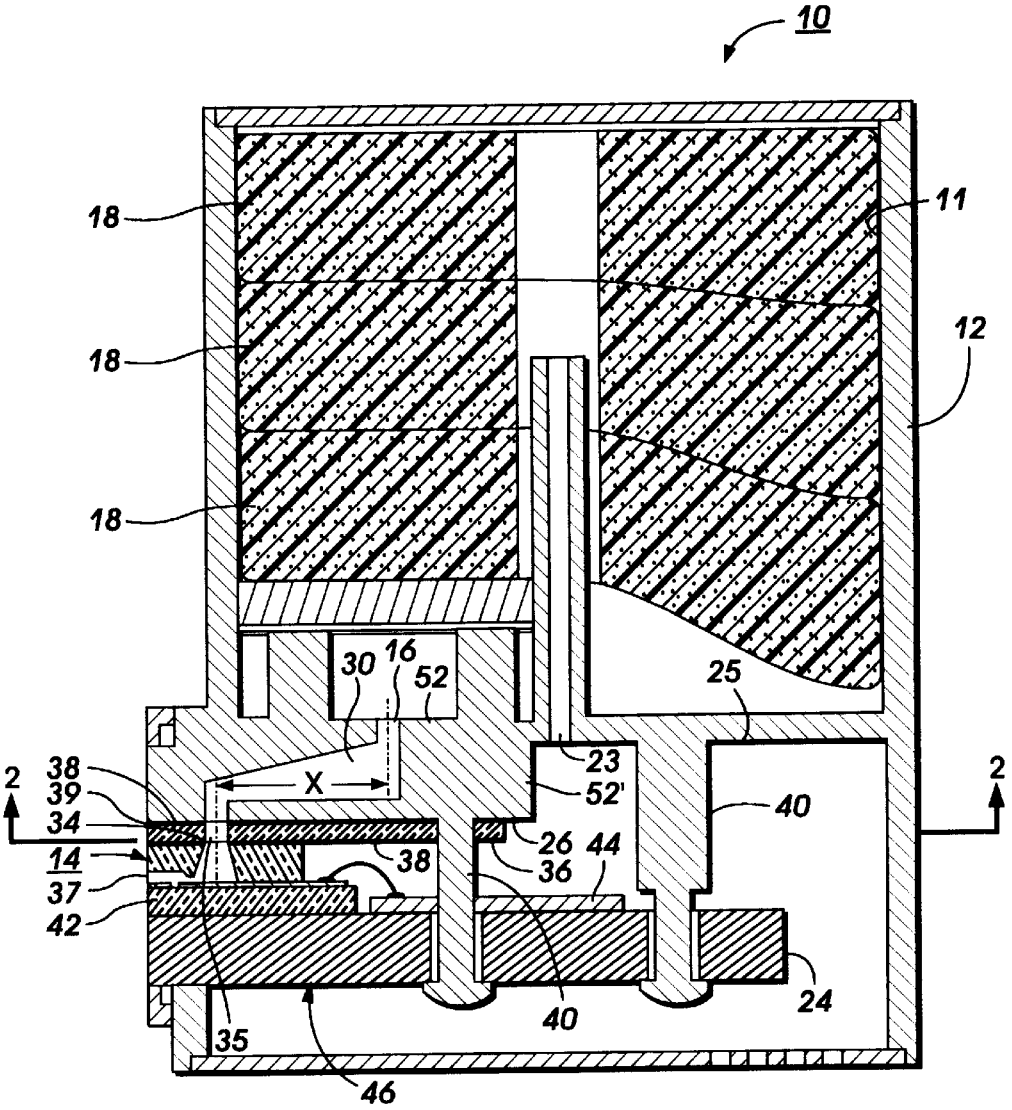
FIG. 1 PRIOR ART
FIG. 1 is a schematic cross-sectional elevation view of a typical ink jet cartridge having a fluid seal therein.

Though a fluid seal having an adhesive coating on opposing sides may be used in many different devices, the fluid seal of this invention will be described as one used in a typical ink jet cartridge, such as that shown in FIG. 1 and described in U.S. Pat. No. 5,519,425, which patent is hereby incorporated by reference. In FIG. 1, a schematic cross-sectional elevation view of a typical ink jet cartridge 10 is depicted having a fluid seal 36 therein. The cartridge comprises a housing 12 and a printhead assembly 46 fixedly attached thereto by stake pins 40. The housing is typically made of a light weight but durable plastic and defines an internal chamber 11 containing an absorbent material 18 for storage of liquid ink therein. The housing has a bottom wall 25 with a ventilation port 23 open to the atmosphere and an output port 16. An elongated recess 30 of varying depth is formed in the outer surface 26 of a thicker portion 52 of the bottom wall 25, the thicker portion thereby forming a step 52' with the exterior surface of the bottom wall. The recess 30 may be integrally molded in the thicker portion of the bottom wall during the fabrication of the housing 12. One end of the elongated recess 30 is connected to the output port 16 and the other end terminates at a location which will align with the inlet 34 of the printhead 14 when, as part of the printhead assembly 46, it is attached to the bottom wall 25 of the housing 12.

The offset distance 'X' between the output port 16 and the printhead inlet 34, typically about 10 mm, is necessitated because the nozzles 37 in the printhead face 42 must be closely spaced from the recording medium (not shown) by a distance of about 20 mils or 0.5 mm. This spacing exceeds the cockling dimension of the recording medium, such as paper, which is the typical response to wet ink on the surface thereof. Thus, the printhead face must be projected beyond the cartridge housing 12, so that the housing cannot contact or drag on the recording medium having the recently printed wet ink images thereon. Thus, the printhead inlet 34 is positioned beyond the cartridge housing, requiring the elongated recess 30 to provide the interconnecting ink flow path between the chamber 11 and the printhead inlet 34. In addition, the recess 30 is geometrically shaped to have a cross-sectional flow area in the elevation view that increases from the printhead inlet 34 to the output port 16 of the chamber 11, so that the ink flow rate therethrough is sufficient and to enable any flow impeding air bubbles in the recess to vent into the chamber 11.

Figure 2:
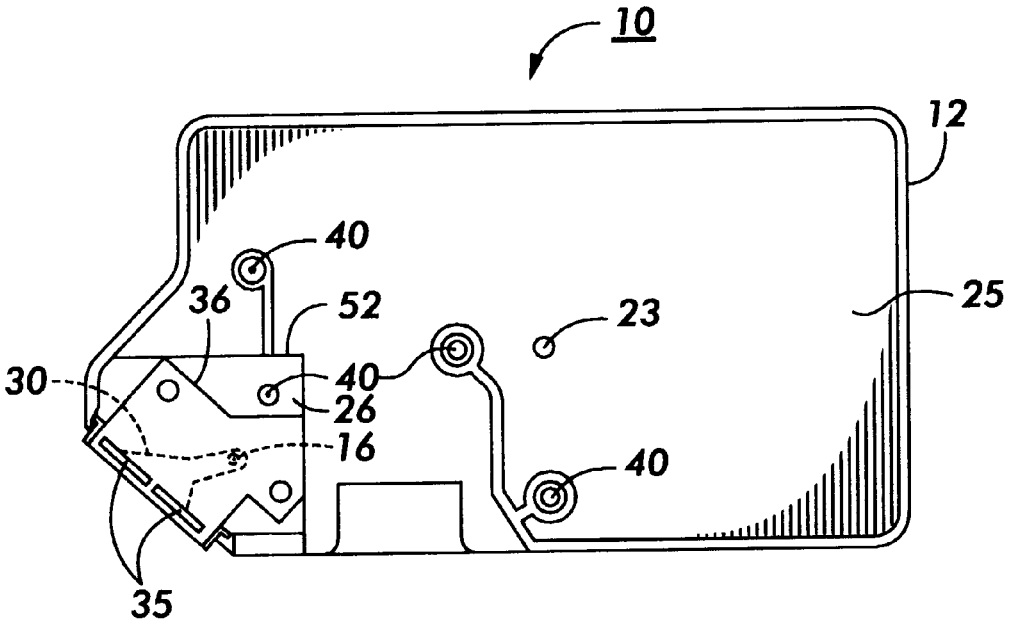
FIG. 2 PRIOR ART
FIG. 2 is a cross-sectional plan view of the cartridge in FIG. 1 as viewed along line 2—2 therein.
Figure 5:
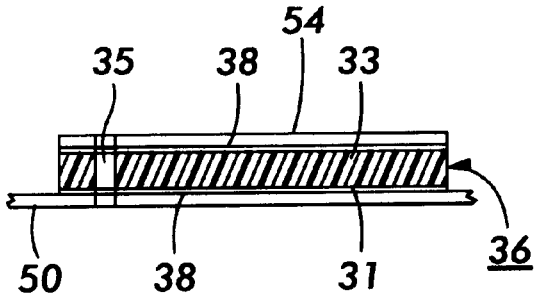
FIG. 5 is a cross-sectional view of a one of the fluid seals as viewed along section line 5—5 of FIG. 4.

The fluid seal 36 covers the recess 30 to complete the ink passageway from the chamber output port 16 and the printhead inlet 34 and has an opening 35 which is aligned with and matches the printhead inlet in size. Referring also to FIGS. 2 and 5, a cross-sectional plan view of the cartridge showing the fluid seal in plan view and a cross-sectional view of the fluid seal, respectively, the fluid seal is a relatively thin film of polyester material, such as Mylar®, having a thickness of about 4 to 10 mils or 0.1 to 0.25 mm and preferably about 7 mils or 0.175 mm. The fluid seal 36 has a predetermined planar shape to avoid the stake pins 40 and to provide adequate coverage of the recess 30. The fluid seal has an opening 35 therein in the shape of a slot, so that the opening matches the shape and size of the elongated printhead inlet 34. Thus, as seen in the plan view of FIG. 2, the recess 30 has a funnel, shape with the larger end being located over the fluid seal opening 35. The fluid seal is bonded to surface 26 of the thicker portion 52 of housing bottom wall 25 covering the recess 30. The fluid seal has opposing surfaces 31, 33, as shown in FIG. 5, each of which are coated with a suitable thermosetting adhesive 38, such as, for example, phenolic nitrile adhesive, having a thickness of about 0.01 to 0.05 mm. The adhesive coating on one side bonds the fluid seal to the thicker portion of the housing bottom wall containing the recess and the adhesive coating on the other side is bonded to the printhead 14, which is assembled with the heat sink 24 and printed circuit board 44 to form the printhead assembly 46. Once the printhead assembly has been installed on the cartridge housing via the stake pins 40, the fluid seal hermetically seals the elongated recess to form a closed ink passageway from the cartridge chamber 11 to the printhead nozzles 37. Because the adhesive 38 is in direct contact with the ink flowing through the passageway formed by the recess 30 and the fluid seal 36, the adhesive should be insoluble in components utilized in the ink.

Figure 3:
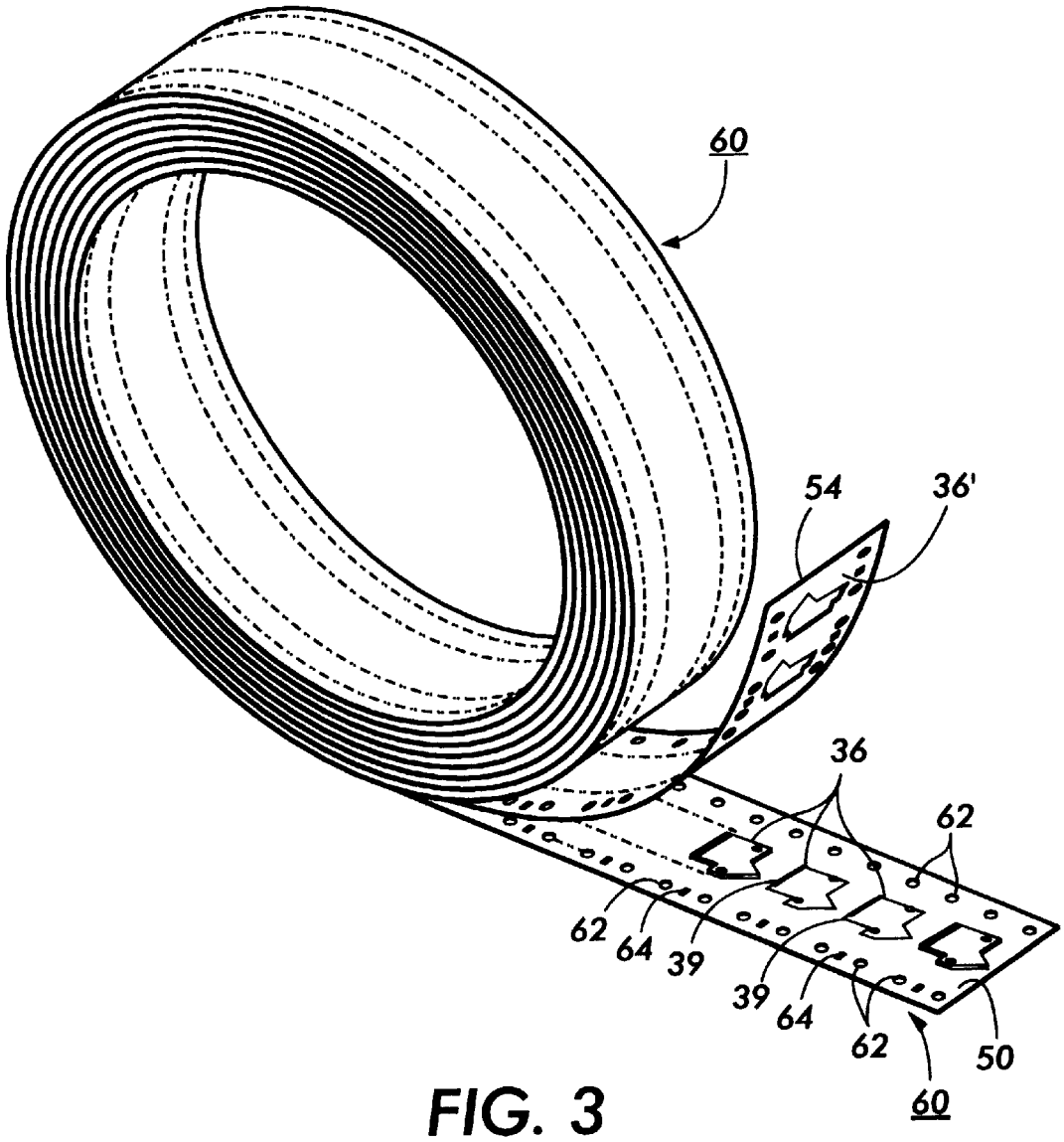
FIG. 3 is a schematic, isometric view of a roll of carrier strip containing a plurality of fluid seals releasably held thereon.

The fluid seals are fabricated by coating the desired adhesive on both sides of a polyester film, such as Mylar®, which may have any shape or size, but in the preferred embodiment is a strip 36' having a width of about 40 mm, as shown in FIG. 3. The double side, adhesive coated strip is then laminated to a 2 to 6 mils or 0.05 to 0.15 mm thick, preferably 0.075 mm thick, polyester film release carrier member 50, which in the preferred embodiment is also in the shape of a strip having the same width as the fluid seal strip. The adhesive coating on the side of the strip 36' (from which the fluid seals 36 will be formed), which will subsequently be bonded to the surface 26 of the raised portion of the cartridge bottom wall 25, is the adhesive side that contacts the carrier member 50. The adhesive coating on the other side of the fluid seal strip is covered by a thinner polyester release paper cover member 54 having a thickness of about 0.025 mm. A progressive punching operation is used to first punch through the entire three layered laminate 60 the critical features of each of the fluid seals' ink openings or slots 35 and front edges 39 which are coplanar with the printhead face 42 (once installed), the tractor feed holes 62, and the spaced rectangular timing apertures 64. Then the remaining profile of the fluid seals are punched through the cover member 54 and fluid seal strip 36' but the carrier member 50 is just scored to a depth of only 0.025 mm. The progressively punched three layered laminate 60 is then rolled on a sleeve or spool (not shown) and installed in a punch mechanism 70 (partially shown in FIGS. 6 and 7) for removing the fluid seals 36 one at a time for presentation to a robotic assembly fixture having a vacuum pick and place end effector (not shown) that places the fluid seal 36 on the cartridge 10. A scrap matrix of the first two layers, comprising the fluid seal strip 36' and cover member 54, minus the fluid seals 36 with cover member 54 thereon which remain on the carrier member, is stripped from the carrier member 50 as the carrier member with fluid seals thereon is stepped through the punch mechanism by tractor wheels (not shown) which engage the tractor feed holes 62 in the carrier member. The tractor wheels are driven by a stepping motor (not shown). In the preferred embodiment, the fluid seals are spaced about every 5 cm along a 100,000 cm long strip of carrier member.

Figure 4:
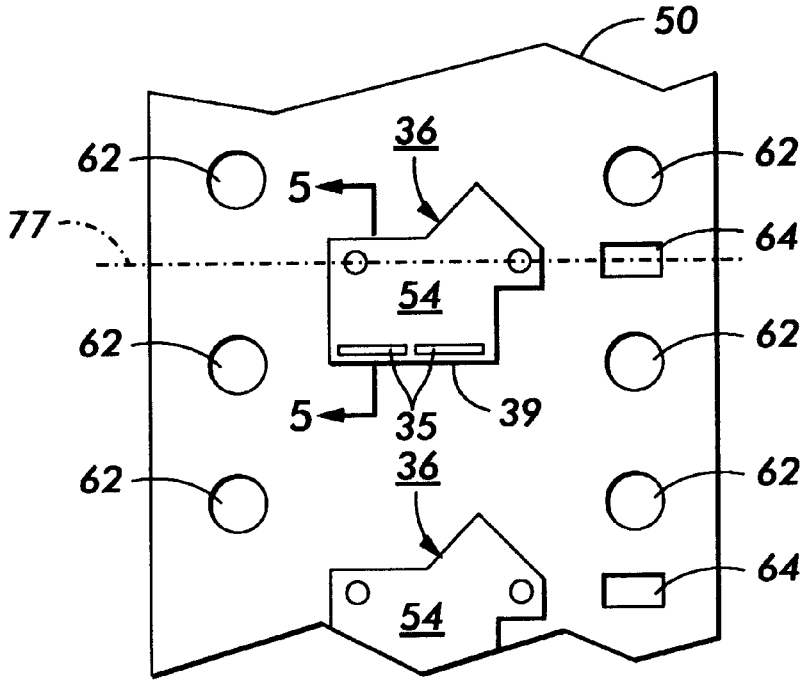
FIG. 4 is a partially shown plan view of the carrier strip of FIG. 3 with the fluid seals thereon shown in aligned registration with the fixed location of a punch mechanism.
Figure 6:
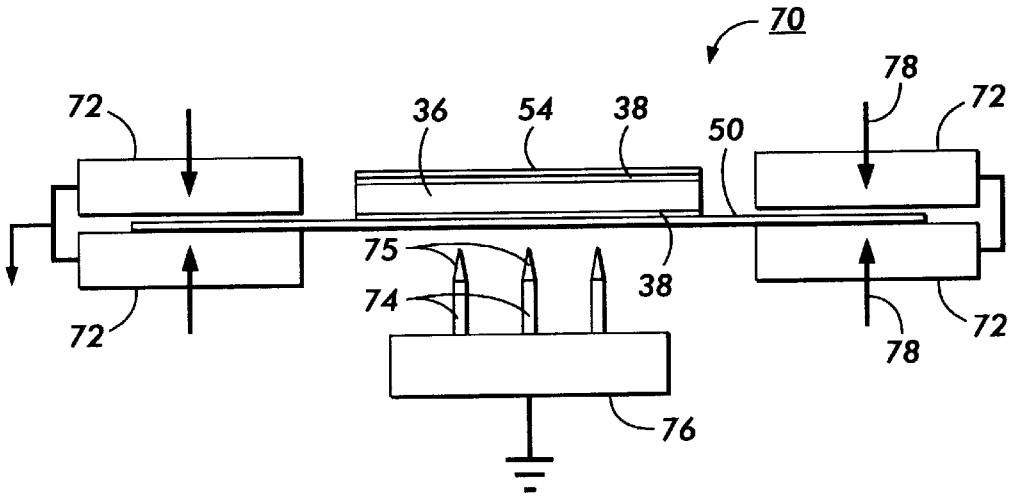
FIG. 6 is schematic, partially shown, cross-sectional view of the punch mechanism with a fluid seal on the carrier member located therein and showing the punch mechanism's set of needles and clamps adjacent the carrier member.
Figure 7:
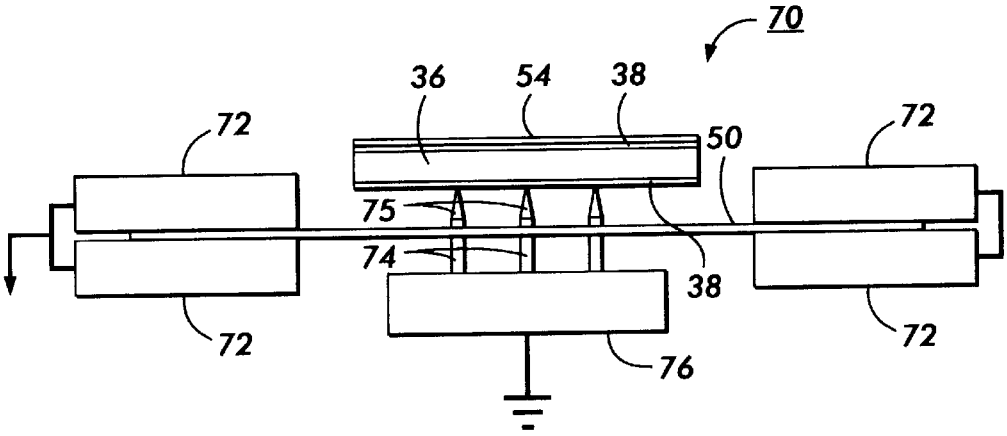
FIG. 7 is a view similar to FIG. 6 with the clamps gripping the carrier member and needle set moved relative to the carrier member, so that the needle set is shown piercing the carrier member and holding the removed fluid seal spaced above the carrier member.

In FIG. 4, a plan view of a portion of the carrier member 50 with the fluid seals 36 spaced therealong is shown with one of the fluid seals located in aligned registration with the fixed location 77 in the punch mechanism 70 (as depicted by a phantom line), whereat the fluid seals are removed one at a time from the carrier member in accordance with the present invention. The stepping motor rotates the tractor wheels (neither shown) which engage the carrier member through the tractor feed holes 62 and advance the carrier member until a photosensor (not shown) detects one of the timing apertures 64 which indicates that a fluid seal is in aligned registration with the fixed location 77 in the punch mechanism. When the photosensor detects a timing aperture, a signal is generated which causes the carrier member to be stopped at the desired fixed location. Referring also to FIG. 6, the schematic, partially shown punch mechanism 70 has a pair of clamps 72 and a set of parallel needles 74 mounted on a support plate 76 are located at the fixed location in the punch mechanism. While carrier member 50 is appropriately registered at this fixed location, clamps on opposing sides of the carrier member are actuated to grip each side of the carrier member as depicted by arrows 78.

After the carrier member is gripped by the clamps 72, the clamps while gripping the carrier member are lowered, so that the set of needles 74 penetrate the carrier member 50 and the sharp points 75 to the needles remove the fluid seal 36 from the carrier member and support the fluid seal thereon. Alternatively, the support plate 76 could be raised and the carrier member held stationary by the clamps 72, so that the needles could penetrate the carrier member and remove the fluid seal. Though only three needles are depicted on the support plate in FIGS. 6 and 7, any number could be used and, in the preferred embodiment, a set of ten needles are used. The needles have the same height of about 0.5 to 2 cm, and preferably about 1 cm, and have a diameter of about 0.05 to 0.1 mm. The needles are fixedly mounted on and perpendicular to the support plate 76 which is oriented about parallel with the clamped carrier member at the fixed location in the punch mechanism. The needle sharp points 75 may substantially penetrate into the adhesive 38 (after passage through the carrier member) but not the fluid seal itself, so that the relatively thin layer of adhesive does not have enough surface contact with the needles to develop an adhering force through surface tension or tackiness of the adhesive. Accordingly, the removed fluid seal is supported on the sharp points of the needles a distance spaced from the carrier member and, thus, is presented for ready access by a vacuum pick and place end effector of an automatic robotic mechanism (neither shown).

The fluid seal 36 is vacuum picked off the needle points 75 by the robotic mechanism and positioned on the surface 26 of the raised portion 52 of the cartridge bottom wall 25 over the recess 30, using a vision system (not shown). A specified slight pressure is used in the preferred embodiment to tack and prevent the fluid seal from becoming misaligned when the vacuum end effector releases the fluid seal. The release cover is then removed by either a higher tack tape or, in the preferred embodiment, a mechanical picker (not shown) which grips the edge of the release cover and peels it off. Next, the printhead assembly is installed on the cartridge by inserting the stake pins 40 through apertures in the heat sink so that the printhead 14 is placed on the awaiting adhesive coating of the fluid seal 36 with the printhead inlet 34 aligned with the fluid seal opening 35. The stake pins are ultrasonically staked to permanently fasten the printhead assembly 46 to the cartridge housing 12, and the adhesive coatings on the fluid seal is partially cured by heating the cartridge to about 125° C. for about eight seconds at 8–14 lbs. force. The fluid seal adhesive 38 is then allowed to cool to room temperature, thereby firmly tacking the fluid seal to the cartridge and printhead. The adhesive is fully cured by heating the fully assembled cartridge 10 in an oven to a temperature of about 150° C. for about 60 minutes without pressure.

After each fluid seal is picked off the needle points, the set of needles are lowered and withdrawn from the carrier member 50, the clamps 72 are released, and the carrier member is stepped through the punch mechanism by the tractor wheels until the next timing aperture 64 in the carrier member is sensed, thereby stopping another fluid seal at the fixed location in the punch mechanism, whereat the carrier member is gripped by the clamps 72 and lowered onto the set of needles 74 which pierce the carrier member and remove the fluid seal therefrom. The fluid seal sits on the needle points and is presented to the robotic mechanism for the pick and placement of the fluid seal on another cartridge housing. Each fluid seal is removed in about 0.5 seconds. This process is repeated until the desired quantity of cartridges have been fabricated. The removal of the fluid seals by set of needles which pierce and lift the double-side, adhesive-coated fluid seal provides an extremely rapid, reliable, non-damaging technique for dispensing a fluid seal for application to a device, such as an ink supply cartridge for an ink jet printer.

Although the foregoing description illustrates the preferred embodiment, other variations are possible and all such variations as will be apparent to those skilled in the art are intended to be included within the scope of this invention as defined by the following claims.

I claim:

1. A method of removing a fluid seal having an adhesive coating on opposite sides thereof from a carrier member, comprising the steps of:

providing a plurality of fluid seals on a carrier member, the fluid seals having opposing surfaces, each surface of the fluid seals containing an adhesive coating thereon having a predetermined thickness, the adhesive coating on one fluid seal surface being in contact with the carrier member, and the adhesive coating on the opposing surface of the fluid seal being covered by a release cover member;

feeding the carrier member through a punch mechanism;

aligning each fluid seal with a fixed location within the punch mechanism;

clamping the carrier member at locations on opposing sides of the punch mechanism when the carrier member is at the fixed location in the punch mechanism;

mounting one end of a set of parallel needles on a support plate, the needles having sharp points at an end opposite the ends which are mounted;

moving the carrier member and set of needles relative to each other and in a direction so that the set of needles approach and penetrate the carrier member;

lifting at least one fluid seal from the carrier member by the needle points; and supporting the at least one fluid seal lifted from the carrier member on the sharp points of the set of needles to enable ready access by an apparatus that will pick up and install the at least one fluid seal on a device, the sharp points of the needle set and the predetermined thickness of the adhesive coating preventing the adhesive coating on the fluid seal which contact said sharp points from becoming attached thereto.

2. The method of removing a fluid seal as claimed in claim 1, wherein the carrier member is a continuous strip of a first polyester film; wherein the plurality of fluid seals is formed from a continuous strip of a second polyester film; and wherein the release cover over each fluid seal is formed from a continuous strip of a third polyester film.

3. The method of removing a fluid seal as claimed in claim 2, wherein the first and third polyester film strips sandwich the second polyester film strip and form a three layer laminate; wherein the fluid seals are formed by a punching operation which punches the shape of the fluid seals through the second and third polyester films, thereby enabling the removal of the non fluid seal portions of the second and third polyester films and leaving only the fluid seals on the first polyester film carrier member with a third polyester film release cover over each of the adhesive coatings on the plurality of fluid seals.

4. The method of removing a fluid seal as claimed in claim 3, wherein the adhesive coating on opposing sides of the fluid seals is a thermosetting pressure sensitive adhesive.

5. The method of removing a fluid seal as claimed in claim 4, wherein the second polyester film is Mylar® having a thickness of about 0.175 mm; wherein the predetermined thickness of the adhesive coatings on each of the sides of the fluid seals is about 0.05 mm thick; wherein the first polyester film carrier member is about 0.076 mm thick; and the third polyester film cover member is about 0.033 thick.

6. The method of removing a fluid seal as claimed in claim 1, wherein the device on which the fluid seal is to be installed is an ink supply cartridge for an ink jet printer.

7. The method of removing a fluid seal as claimed in claim 1, wherein the needles are substantially cylindrical, have a diameter of about 0.05 mm, and are oriented perpendicular to the support plate and carrier member, with the needle points confrontingly adjacent the carrier member prior to the relative movement of the needles and carrier member.

* * * * *